US007075222B2

(12) United States Patent
Kim

(10) Patent No.: US 7,075,222 B2
(45) Date of Patent: Jul. 11, 2006

(54) COLOR CATHODE RAY TUBE

(75) Inventor: Byoung-Chul Kim, Kyeongsangbuk-Do (KR)

(73) Assignee: LG. Philips Displays Korea Co., Ltd., Kyeongsangbuk-Do (KR)

( * ) Notice: Subject to any disclaimer, the term of this patent is extended or adjusted under 35 U.S.C. 154(b) by 159 days.

(21) Appl. No.: 10/763,320

(22) Filed: Jan. 26, 2004

(65) Prior Publication Data

US 2004/0263054 A1 Dec. 30, 2004

(30) Foreign Application Priority Data

Jun. 25, 2003 (KR) ..... 10-2003-0041730

(51) Int. Cl.
*H01J 31/00* (2006.01)
*H01J 29/00* (2006.01)

(52) U.S. Cl. ..... 313/477 R; 313/461; 220/2.1 R; 220/2.1 A

(58) Field of Classification Search ..... 313/477 R, 313/461, 402, 408; 220/2.1 A, 2.1 R
See application file for complete search history.

(56) References Cited

U.S. PATENT DOCUMENTS 4,623,818 A * 11/1986 Yamazaki ..... 313/477 R
5,416,379 A * 5/1995 Inoue et al. ..... 313/477 R
5,519,283 A * 5/1996 Opresko et al. ..... 313/402

* cited by examiner

*Primary Examiner*—Mariceli Santiago
(74) *Attorney, Agent, or Firm*—Birch, Stewart, Kolasch & Birch, LLP

(57) ABSTRACT

A color cathode ray tube is provided in which an inner radius of curvature is designed as $0.3 \leqq (Rxe/Rxc) \leqq 0.5$, to obtain a structural intensity of a panel mask corresponding to the inner curvature of the cathode ray tube panel to decrease partial doming and increase a drop characteristic.

15 Claims, 5 Drawing Sheets

COLOR CATHODE RAY TUBE

This Non-provisional application claims priority under 35 U.S.C. § 119(a) on Patent Application No(s). 10-2003-0041730 filed in Korea on Jun. 25, 2003, the entire contents of which are hereby incorporated by reference.

BACKGROUND OF THE INVENTION

1. Field of the Invention

The present invention relates to a color cathode ray tube, and more particularly, to a color cathode ray tube capable of obtaining a structural intensity of a mask corresponding to a panel, decreasing a partial doming, and increasing a drop characteristic by setting a curvature of the panel to be greater from a center portion of the panel towards a peripheral portion thereof.

2. Description of the Related Art

Generally, a color cathode ray tube is for implementing images, and is divided into a curved type cathode ray tube and a flat type cathode ray tube according to an appearance of a panel.

The curved type cathode ray tube has several problems such as an image distortion, eyes fatigue due to light reflection, and etc. thus to have decreasing demands, whereas the flat type cathode ray tube has advantages in that images are not distorted, reflection for external light is minimized, and maximization of a visual region can be implemented thus to have increasing demands.

FIG. 1 is a longitudinal section view showing a color cathode ray tube in accordance with the conventional art.

As shown, the conventional color cathode ray tube comprises a panel 1 having a fluorescent surface 1*a*, a mask 2 for selecting colors of electron beams incident from an inner side of the panel 1, a funnel 3 coupled to a rear surface of the panel 1 for maintaining inside of the cathode ray tube as a vacuum state, an electron gun 5 mounted in a neck portion 4 of the funnel 3 for emitting electron beams, and a deflection yoke 6 for surrounding outside of the funnel 3 and deflecting electron beams.

In the conventional color cathode ray tube, when image signals are inputted to the electron gun 5, the electron gun 5 emits electron beams and the emitted electron beams are accelerated and focused towards the panel 1 according to voltages applied from each electrode of the electron gun 5.

At this time, the electron beams are deflected by the deflection yoke 6 thus to pass slots formed at the mask 2, and thereby colors of the electron beams are selected. Then, the electron beams collide with the fluorescent surface 1*a* inside the panel 1 thus to make each fluorescent surface 1*a* emit light, thereby reproducing images.

In the conventional color cathode ray tube, a method for reducing a center thickness of a panel or a method for flattening an inner surface of a panel were used in order to make the cathode ray tube light and to reduce a cost.

However, in the method for reducing a center thickness of a panel, when the center thickness of a panel becomes thinner than a current standard of 10.5 mm, x-ray emission amount is increased thus to have a limitation.

Also, in the method for flattening an inner surface of a panel, the inner surface of a panel becomes gradually flat and thereby a curvature of a mask becomes gradually flat, thereby decreasing a structural intensity of a mask and thus deteriorating a drop quality (a drop characteristic). Also, when the panel mask becomes flat, electron beams which have passed through mask holes do not correctly hit red, green, and blue phosphors of a screen by a thermal expansion of the mask, thereby generating a partial doming that a color purity of a screen is deteriorated.

To prevent said partial doming, in the conventional art, invar steel, a low thermal expansion material instead of AK, a high thermal expansion material was used to fabricate a mask, which was disclosed in Japanese patent 1984-15861.

In case of using a mask of said invar steel material (hereinafter, invar mask), a thermal expansion of a mask can be decreased. However, in this case, the cost is high, a mechanical workability is very poor thus to have an annealing process temperature more than 900° C., and a metallic pattern has to be heated at the time of forming the mask.

Also, the invar mask has a low structural intensity compared to a mask of AK material (AK mask) and causes a drop characteristic deterioration, so that a wedge ratio of a panel (a ratio of a corner thickness of a panel for a center thickness) was set to be 220% or more than and a mask curvature was set to be similar to a spherical type, that is, to be similar to a single curvature radius R in the conventional art. According to this, an optimum curvature of a panel which is light, reduces a fabrication cost, and increases a structural intensity could not be implemented.

SUMMARY OF THE INVENTION

Therefore, an object of the present invention is to provide a color cathode ray tube capable of obtaining a structural intensity of a mask corresponding to a panel, decreasing a partial doming, and increasing a drop characteristic by setting a curvature of the panel to be greater from a center portion of the panel towards a peripheral portion thereof.

To achieve these and other advantages and in accordance with the purpose of the present invention, as embodied and broadly described herein, there is provided a color cathode ray tube comprising: a panel of which an outer surface is substantially plane and an inner surface has a predetermined curvature; and a mask for selecting colors of electron beams incident from inside of the panel, in which a formula, $0.3 \leqq (Rxe/Rxc) \leqq 0.75$ is satisfied.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Hereinafter, a color cathode ray tube according to the present invention will be explained in more detail.

Figure 1:
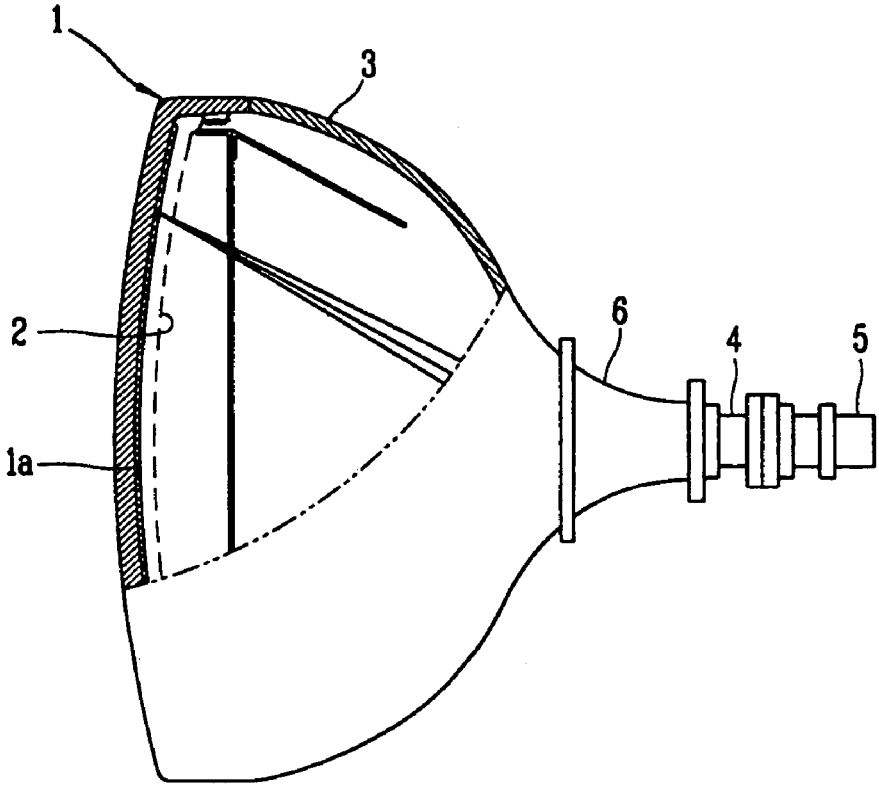
FIG. 1 RELATED ART
FIG. 1 is a longitudinal section view showing a color cathode ray tube in accordance with the conventional art.
Figure 2:
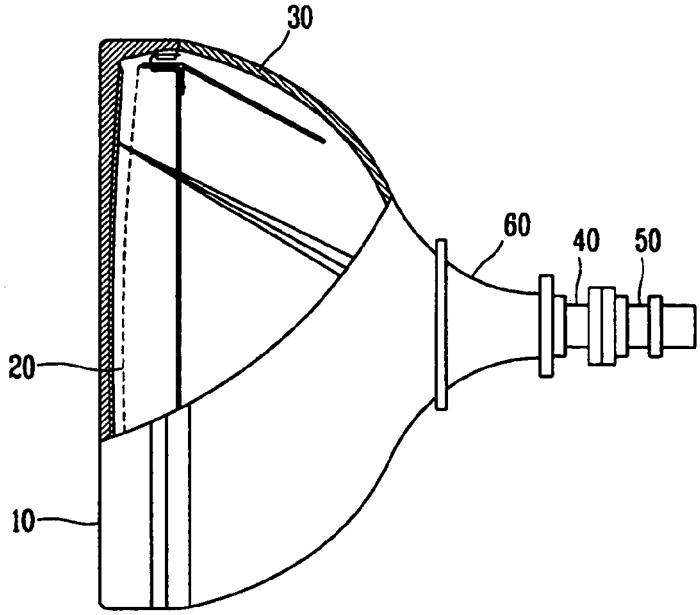
FIG. 2 is a longitudinal section view showing a color cathode ray tube according to the present invention.
Figure 3:
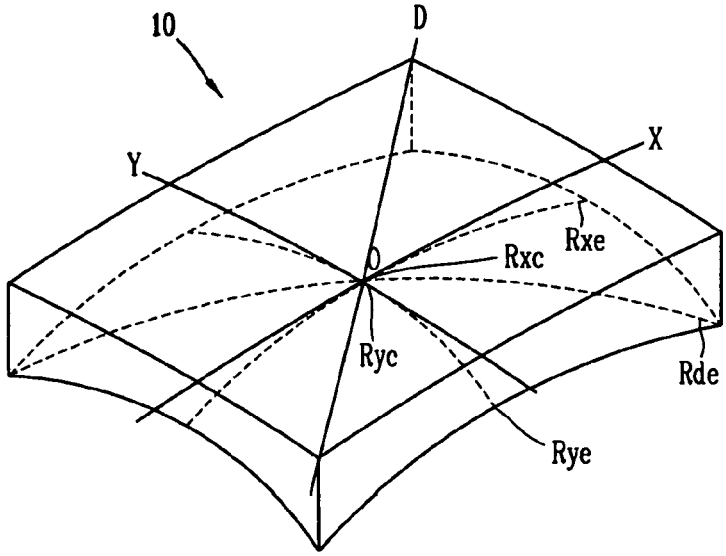
FIG. 3 is a perspective view showing an effective surface of a panel in a color cathode ray tube according to the present invention.

FIG. 2 is a longitudinal section view showing a color cathode ray tube according to the present invention, and FIG. 3 is a perspective view showing an effective surface of a panel in a color cathode ray tube according to the present invention.

As shown in FIGS. 2 and 3, in the color cathode ray tube of the present invention, a curvature of a panel is increased from a center portion of the panel 10 towards a peripheral portion of an effective surface at the time of forming an inner curvature of the panel.

In case of increasing the inner curvature of the panel from the center portion of the panel 10 towards the peripheral portion of the effective surface (hereinafter, a super arc), a structural intensity of a mask corresponding to the inner curvature of the panel can be obtained, thereby effectively solving problems such as a partial doming generated at the time of using an AK mask or a tint panel.

Especially, in the present invention, the partial doming can be more effectively reduced by forming an inner curvature of the panel to be relatively greater than a curvature of the center portion at a ⅔ region from the effective surface center portion towards the peripheral portion of the panel, the weakest region for the partial doming of the cathode ray tube.

Hereinafter, a long axis is defined as a line in the center of the panel parallel to a longer side of the panel, a short axis is defined as a line in the center of the panel parallel to a shorter side of the panel, a Rxe is defined as an inner curvature radius at an edge of a long axis of the panel, a Rye is defined as an inner curvature radius at edge of a short axis of the panel, a Ryc is defined as an inner curvature radius at a center of a short axis of the panel, a Rxc is defined as an inner curvature radius at a center of a long axis of the panel, a Rdc is defined as an inner curvature radius at a center of a diagonal axis of the panel, a Rde is defined as an inner curvature radius at a edge of a diagonal axis of the panel, and a USD is defined as an effective surface diagonal distance of the panel.

The color cathode ray tube according to the present invention comprises a panel 10 of which an outer surface is substantially plane and an inner surface has a predetermined curvature, a mask 20 for selecting colors of electron beams, a funnel 30 coupled to a rear surface of the panel 10 for maintaining inside of the cathode ray tube as a vacuum state, an electron gun 50 for emitting electron beams, and a deflection yoke 60 for deflecting electron beams. At the time of forming the inner curvature of the panel 10, the panel curvature is increased towards the peripheral portion of the effective surface from the center portion of the panel 10, and a formula, $0.3 \leqq (Rxe/Rxc) \leqq 0.75$ is satisfied.

Also, formulas, $4.5 \leqq Rxc/USD \leqq 8.5$, $0.3 \leqq Rye/Ryc \leqq 1.0$, and $Rxe \leqq Rde \leqq Rye$ are satisfied, and the USD is 500 mm or less than.

In the color cathode ray tube of the present invention, a mask of AK material or a mask of invar material can be used. In case of using a mask of AK material, formulas, $0.3 \leqq (Rxe/Rxc) \leqq 0.5$, $4.5 \leqq (Rxc/USD) \leqq 8.5$, $0.3 \leqq (Rye/Ryc) \leqq 1.0$, and $Rxe \leqq Rde \leqq Rye$ are preferably satisfied, and the USD is 500 mm or less than. Also, a transmission ratio of the center portion of the panel 10 is 45%~75%, and the wedge ratio is 180%~220%.

In case of using a mask of Fe—Ni based alloy invar or a Fe—Ni—Co based alloy ultra invar, formulas, $0.5 \leqq (Rxe/Rxc) \leqq 0.75$, $4.5 \leqq (Rxc/USD) \leqq 6.5$, $0.3 \leqq (Rye/Ryc) \leqq 1.0$, and $Rxe \leqq Rde \leqq Rye$ are satisfied, the USD is 500 mm or less than, and the wedge ratio is 200% or more than.

Hereinafter, the super arc ratio of the color cathode ray tube according to the present invention will be explained.

Figure 4:
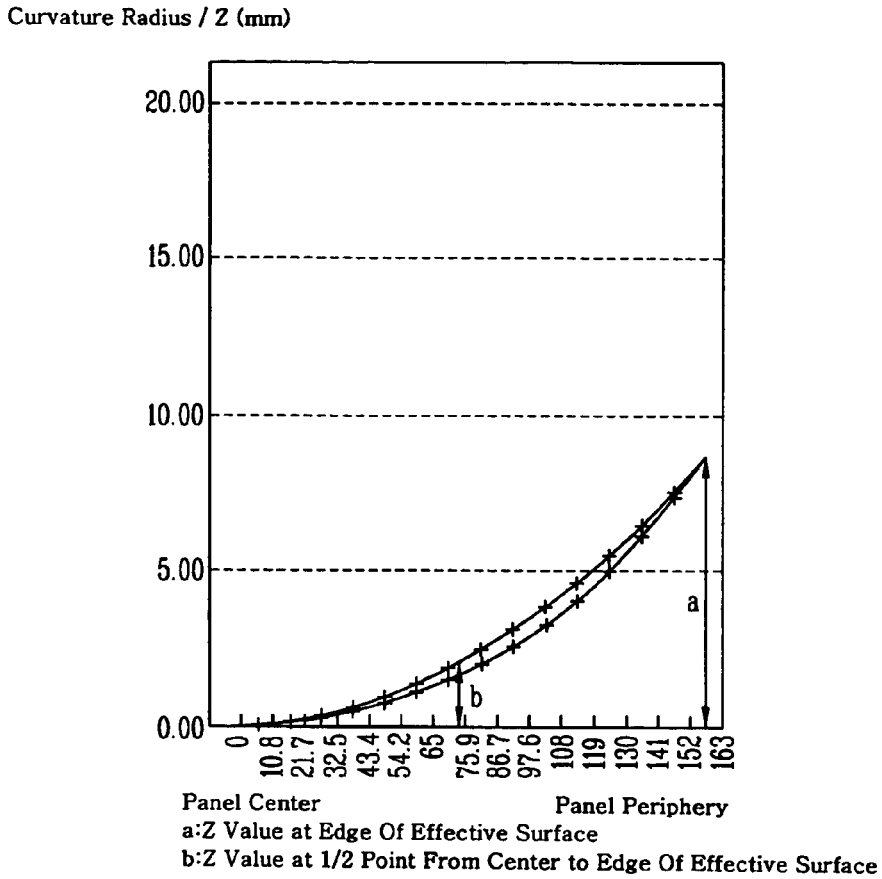
FIG. 4 is a graph showing a super arc ratio.

FIG. 4 is a graph showing the super arc ratio.

a: curvature value Z of an edge of the effective surface of the panel (Z is height difference between a point on the inner surface of the center portion of the panel and a point on the inner surface of the peripheral portion of the effective surface of the panel)

b: curvature value Z at a ½ point from the center of the panel towards the edge of the effective surface horizontal axis: distance (mm) from the center of the panel to the edge of the effective surface vertical axis: curvature radius/curvature value (Z)

In the conventional color cathode ray tube, the inner curvature radius of the panel is formed as a single R, so that the inner curvature radius from the center portion of the panel to the edge of the effective surface is equal. However, in the color cathode ray tube of the present invention, the inner curvature radius of the panel is formed as a super arc and a mask curvature corresponding to the inner curvature of the panel is designed as a super arc without an infection point, thereby obtaining a structural intensity of the mask, increasing a drop characteristic, and thus reducing a partial doming.

Also, in the color cathode ray tube of the present invention, the curvature value(Z) is drastically increased from the center portion of the panel towards the peripheral portion, which shows that a curvature is drastically increased from the center portion of the panel towards the peripheral portion.

Hereinafter, the AK mask and the invar mask will be explained with comparison each other.

Figure 5:
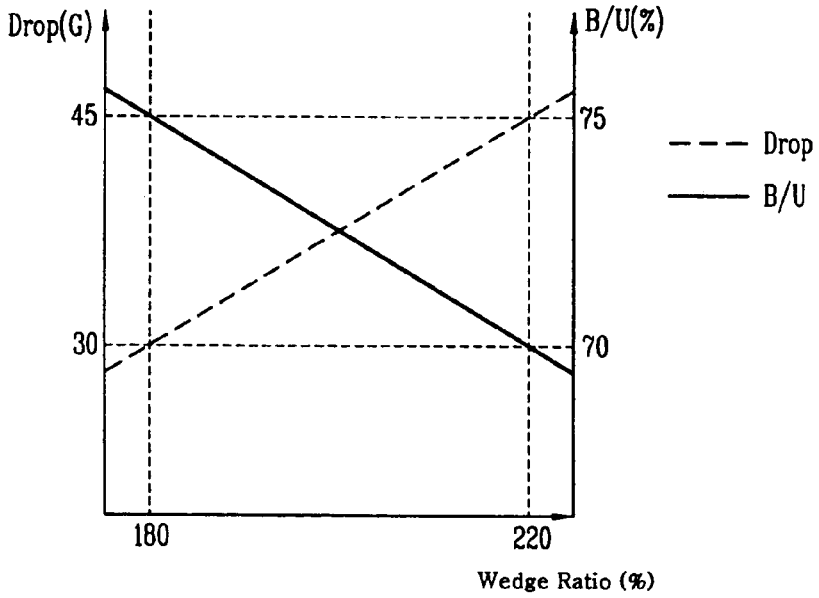
FIG. 5 is a graph showing a drop quality and B/U according to a wedge ratio in a color cathode ray tube using an AK mask.

FIG. 5 is a graph showing a drop quality and B/U according to a wedge ratio in a color cathode ray tube using the AK mask.

As shown, a thermal expansion of the AK mask is approximately 5 times greater than that of the invar mask, so that a partial doming that a color purity of a screen is deteriorated has to be solved at the time of using the AK mask.

That is, in case of using the invar mask, the partial doming is 20 μm or less than thus not to generate a phenomenon that the color purity of the screen is deteriorated. However, in case of using the AK mask, the partial doming is 70 μm or more than, which corresponds to approximately 3 times of the invar mask in the same curvature mask and causes the color purity of the screen to be deteriorated.

The mask curvature is varied according to the inner curvature of the panel even in case of a mask having the same wedge ratio, so that the inner curvature of the panel has to be designed as a form to reduce the partial doming.

In case of a cathode ray tube using the AK material mask, a drop characteristic and B/U according to the wedge ratio of the panel are shown in a following table 1 and FIG. 5.

TABLE 1

| | Wedge ratio (%) | | | | | |
|---|---|---|---|---|---|---|
| | 170 | 180 | 190 | 200 | 210 | 220 |
| Drop characteristic | 25 | 30 | 35 | 40 | 45 | 50 |
| B/U | 80 | 78 | 76 | 74 | 72 | 70 |

As shown in the table 1 and FIG. 5, a drop characteristic of cathode ray tube for a general monitor (CDT), 30 G or more than, is satisfied in case of the panel wedge ratio of 180%~220%. However, when the wedge ratio exceeds 220%, the B/U, brightness of a corner of a screen of a monitor for a center, is lowered into 70% or less than, thereby having a difficulty in using a tint panel.

Accordingly, in order to use the AK mask and the tint panel, the wedge ratio of the panel has to be 180%~220% and the B/U has to be 70~78 thus to satisfy a required drop characteristic of the CDT.

Figure 6:
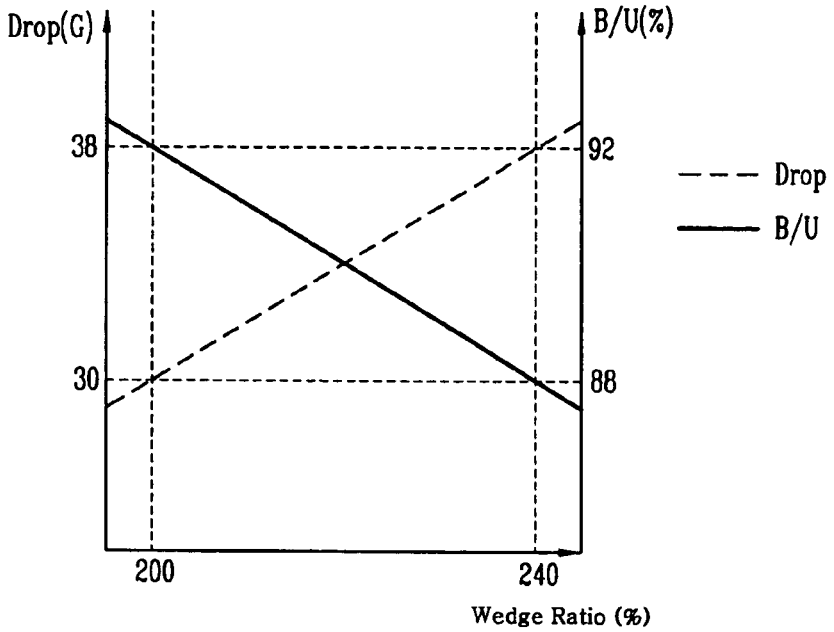
FIG. 6 is a graph showing a drop quality and B/U according to a wedge ratio in a color cathode ray tube using an invar mask.

FIG. 6 is a graph showing a drop quality and B/U according to a wedge ratio in a color cathode ray tube using an invar mask.

As shown, in case of a cathode ray tube using an invar mask, the drop characteristic and B/U according to the wedge ratio of the panel are shown in a following table 2 and FIG. 6.

TABLE 2

| | Wedge ratio (%) | | | | | |
|---|---|---|---|---|---|---|
| | 190 | 200 | 210 | 220 | 230 | 240 |
| Drop characteristic | 28 | 30 | 32 | 34 | 36 | 38 |
| B/U | 93 | 92 | 91 | 90 | 89 | 88 |

As shown in the table 2 and FIG. 6, in case of using the invar mask, the wedge ratio has to be 200% or more than in order to satisfy the drop characteristic and the B/U can be satisfied regardless of the wedge ratio.

A following table 3 shows a reducing ratio of the partial doming according to a variance of the curvature radius.

TABLE 3

| | Curvature radius (mm) | | | | | |
|---|---|---|---|---|---|---|
| | 1600 | 1500 | 1400 | 1300 | 1200 | 1100 |
| Partial doming | 23 | 21 | 19 | 17 | 15 | 14 |
| Reducing ratio | −9.5 | 0 | 9.5 | 19 | 28 | 33 |

As shown in the table 3, as a measurement result of the partial doming with an invar mask having a thickness of 0.12 mm, when the curvature radius of the panel is varied from 1500 mm to 1100 mm (when a curvature is increased), the partial doming is varied from 21 μm to 14 μm, which means the partial doming is varied nearly similarly to the variation ratio of the curvature radius of the panel. That is, the table 3 shows that the partial doing is decreased accordingly as the inner curvature of the panel is increased.

As can be seen from said result, in order to use the AK mask and the tint panel, the wedge ratio of the panel has to be 180%~220% thus to satisfy required drop characteristic of the CDT. Also, in case of using the invar mask, the wedge ratio has to be 220% or more than in order to satisfy the drop characteristic.

Figure 7:
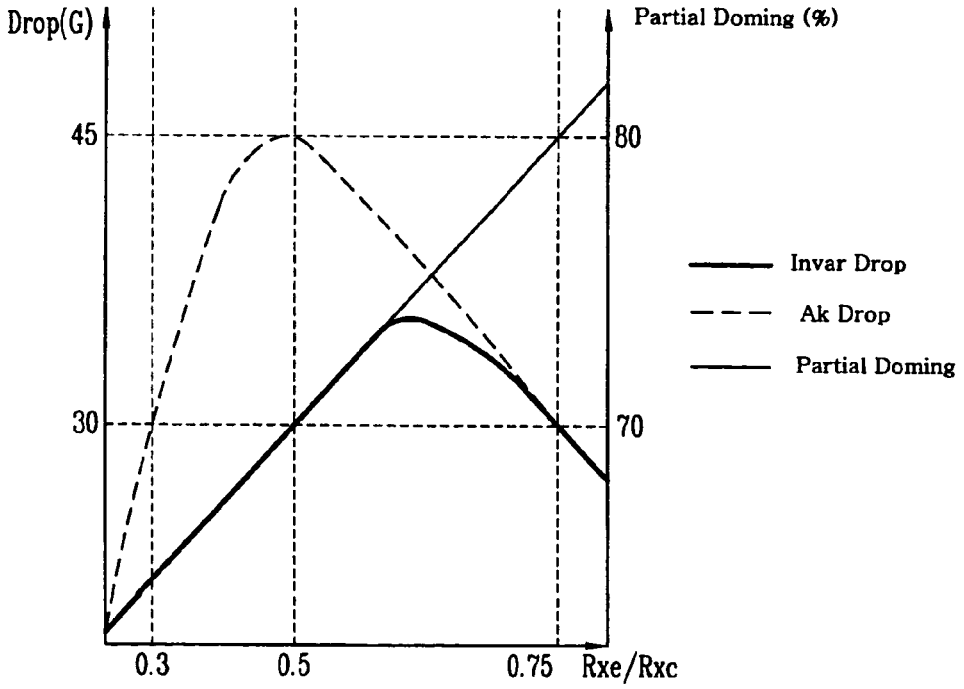
FIG. 7 is a graph showing a drop characteristic and a partial doming according to Rxe/Rxc.

FIG. 7 is a graph showing a drop characteristic and a partial doming according to Rxe/Rxc.

As shown, the super arc ratio of the inner curvature of the panel along a long axis has to exceed 20% in order to satisfy 30 G(Gravity), the drop characteristic of the cathode ray tube in a wedge ratio of 220% or less than even if a structural intensity of the mask is increased by using the AK material.

In order to decrease the partial doming with 30% or more than, the super arc ratio has to be increased. In this case, a ratio of the inner curvature radius of the effective surface edge for the inner curvature radius of the center portion of the panel along the long axis satisfies a following formula, $0.3 \leqq (Rxe/Rxc) \leqq 0.75$, more preferably, formulas, $0.3 \leqq (Rxe/Rxc) \leqq 0.5$, $4.5 \leqq (Rxc/USD) \leqq 8.5$, $0.3 \leqq (Rye/Ryc) \leqq 1.0$, and $Rxe \leqq Rde \leqq Rye$. Also, the USD, a diagonal size of an effective surface of the panel is 500 mm or less than, a transmission ratio of the center portion of the panel is 45%~75%, and the wedge ratio of 180%~220% is satisfied.

Also, in case of using the invar mask and increasing the wedge ratio as 200% or more than, the super arc ratio is 22%~24% and the inner curvature radius satisfies following formulas, $0.3 \leqq (Rxe/Rxc) \leqq 0.75$, more preferably, formulas, $0.5 \leqq (Rxe/Rxc) \leqq 0.75$ and $4.5 \leqq (Rxc/USD) \leqq 6.5$.

Figure 8:
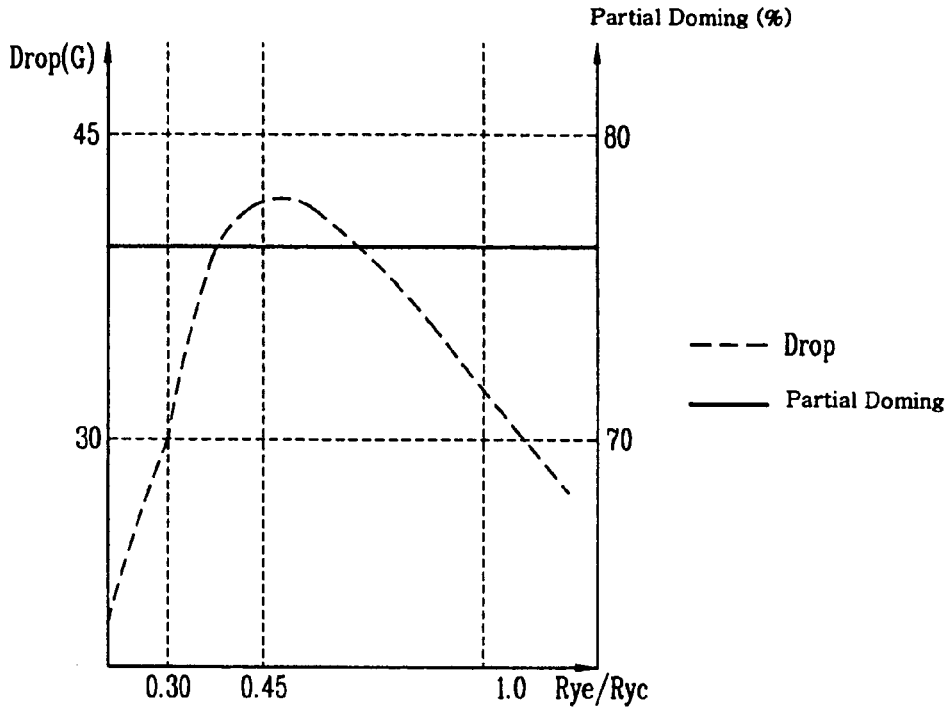
FIG. 8 is a graph showing a drop characteristic and a partial doming according to Rye/Ryc.

FIG. 8 is a graph showing a drop characteristic and a partial doming according to Rye/Ryc.

As shown, a super arc ratio along a short axis can be expressed as $0.3 \leqq (Rye/Ryc) \leqq 1.0$ as a relation formula of the curvature radius.

When the Rye/Ryc is 0.3 or more than, the drop characteristic of the cathode ray tube is satisfied. The Rye/Ryc shows a maximum value at 0.45 and is gradually decreased. In case that the Rye/Ryc is 1.0 or more than, the drop characteristic of the cathode ray tube is scarcely satisfied.

For reference, a measuring point of the partial doming is positioned on the longer side, so that the partial doming is influenced only by the long axis not by the short axis. On the contrary, the drop characteristic is influenced by both the long axis and the short axis.

Figure 9:
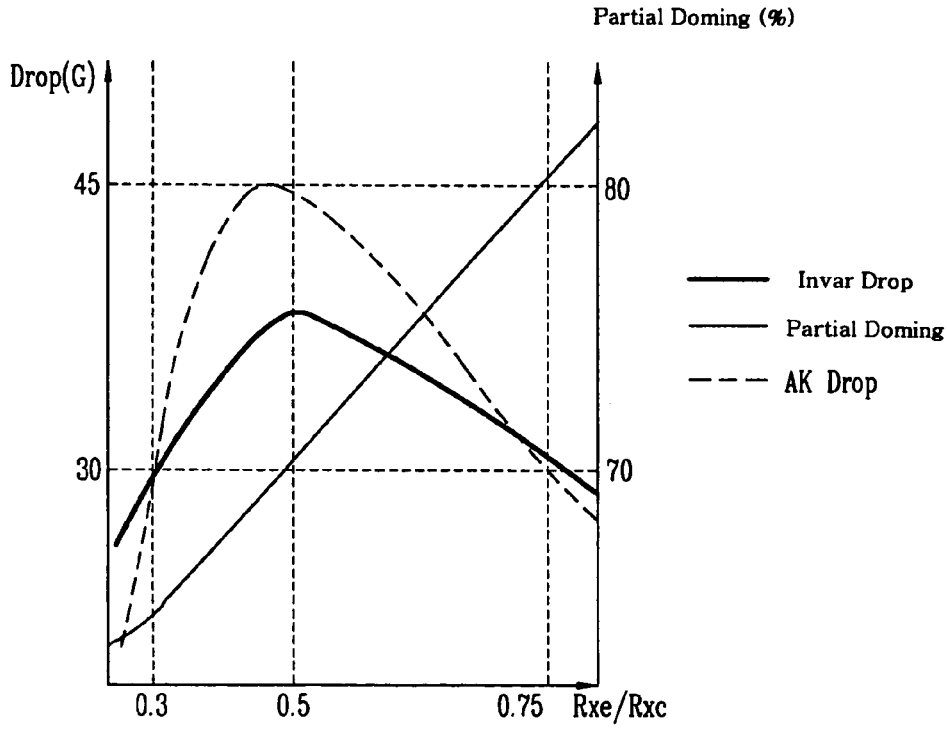
FIG. 9 is a graph showing a drop characteristic and a partial doming according to Rye/Rxc.

FIG. 9 is a graph showing a drop characteristic and a partial doming according to Rye/Rxc.

As shown, the drop characteristic is satisfied even in the invar mask when the wedge ratio is 230% or more than. Therefore, in case of applying mask of material having a high intensity, ultra invar mask, or super invar mask besides the currently used invar mask, a structural intensity of the mask is increased thus to satisfy a formula, $0.3 \leqq (Rxe/Rxc) \leqq 0.75$ in the wedge ratio of 210% or less than.

Also, in case of using a mask of another material having a middle thermal expansion coefficient between the invar material and the AK material, the partial doming is decreased thus to satisfy a formula, $0.3 \leqq (Rxe/Rxc) \leqq 0.75$.

In the method for reducing the partial doming by the super arc, the Rxe, the inner curvature radius at an edge of the long axis is the smallest and the Rye, the inner curvature radius at an edge of the short axis is the greatest, which can be expressed as $Rxe \leqq Rde \leqq Rye$.

In the present invention, the super arc ratio is gradually increased towards the long axis in order to form a curvature at a ⅓ point of the long axis, a measuring point of the partial doming greatly. Therefore, the inner curvature of the edge of the effective surface along the long axis is relatively formed to be greater than that along the short axis or that along the diagonal axis.

The present invention is more effective in a cathode ray tube of 21" or less than of which USD is 500 mm or less than. Also, in case of a large cathode ray tube, since the large cathode ray tube requires lower drop characteristic G than a smaller cathode ray tube, the present invention can be also applied to the large cathode ray tube.

As aforementioned, at the time of forming the inner curvature of the panel according to the present invention, relations among the inner curvature radius at a center of a long axis of the panel (Rxc), the inner curvature radius at an edge of a long axis of the panel (Rxe), the inner curvature radius at a center of a short axis of the panel (Ryc), the inner curvature radius at an edge of a short axis of the panel (Rye), the inner curvature radius at an edge of the diagonal axis of the panel (Rde), and the diagonal size of an effective surface of the panel (USD) are set, and the inner curvature of the panel is increased from the center portion of the panel towards the peripheral portion of the effective surface, thereby obtaining a structural intensity of the mask, thus increasing the drop characteristic, and effectively preventing the partial doming.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A color cathode ray tube comprising:

a panel of which an outer surface is substantially plane and an inner surface has a predetermined curvature; and a mask for selecting colors of electron beams incident from inside of the panel, in which a formula, $0.3 \leqq (Rxe/Rxc) \leqq 0.5$ is satisfied, wherein Rxe is an inner curvature radius at an edge of a long axis of the panel, and Rxc is an inner curvature radius at a center of a long axis of the panel.

2. The color cathode ray tube of claim 1, wherein the inner curvature radius is gradually decreased from a center portion of the panel towards a peripheral portion of the panel.

3. The color cathode ray tube of claim 1, wherein the mask is formed of AK material.

4. The color cathode ray tube of claim 1, wherein a USD of the panel is 500 mm or less, and wherein the USD is a diagonal size of an effective surface of the panel.

5. The color cathode ray tube of claim 1, wherein the mask is formed of either Fe—Ni based alloy or Fe—Ni—Co based alloy.

6. The color cathode ray tube of claim 5, wherein a USD of the panel is 500 mm or less, and wherein USD is a diagonal size of an effective surface of the panel.

7. A color cathode ray tube comprising:

panel of which an outer surface is substantially plane and an inner surface has a predetermined curvature; and a mask for selecting colors of electron beams incident from inside of the panel, in which a formula, $0.3 \leqq (Rxe/Rxc) \leqq 0.75$ is satisfied, wherein Rxe is an inner curvature radius at an edge of a long axis of the panel, and Rxc is an inner curvature radius at a center of a long axis of the panel, wherein a formula, $4.5 \leqq (Rxc/USD) \leqq 8.5$ is satisfied, and wherein the USD is a diagonal size of an effective surface of the panel.

8. A color cathode ray tube comprising:

a panel of which an outer surface is substantially plane and an inner surface has a predetermined curvature; and a mask for selecting colors of electron beams incident from inside of the panel, in which a formula, $0.3 \leqq (Rxe/Rxc) \leqq 0.75$ is satisfied, wherein Rxe is an inner curvature radius at an edge of a long axis of the panel, and Rxc is an inner curvature radius at a center of a long axis of the panel, and wherein a transmission ratio of a center portion of the panel is 45%~75%.

9. A color cathode ray tube comprising:

a panel of which an outer surface is substantially plane and an inner surface has a predetermined curvature; and a mask for selecting colors of electron beams incident from inside of the panel, in which a formula, $0.3 \leqq (Rxe/Rxc) \leqq 0.75$ is satisfied, wherein Rxe is an inner curvature radius at an edge of a long axis of the panel, and Rxc is an inner curvature radius at a center of a long axis of the panel, and wherein an wedge ratio is 180%~220%.

10. A color cathode ray tube comprising:

a panel of which an outer surface is substantially plane and an inner surface has a predetermined curvature; and a mask for selecting colors of electron beams incident from inside of the panel, in which a formula, $0.3 \leqq (Rxe/Rxc) \leqq 0.75$ is satisfied, wherein Rxe is an inner curvature radius at an edge of a long axis of the panel, and Rxc is an inner curvature radius at a center of a long axis of the panel, wherein the mask is formed of either Fe—Ni based alloy or Fe—Ni—Co based alloy, wherein a formula, $4.5 \leqq (Rxc/USD) \leqq 6.5$ is satisfied, and wherein USD is a diagonal size of an effective surface of the panel.

11. A color cathode ray tube comprising:

a panel of which an outer surface is substantially plane and an inner surface has a predetermined curvature; and a mask for selecting colors of electron beams incident from inside of the panel, in which a formula, $0.3 \leqq (Rxe/Rxc) \leqq 0.75$ is satisfied, wherein Rxe is an inner curvature radius at an edge of a long axis of the panel, and Rxc is an inner curvature radius at a center of a long axis of the panel, wherein the masks is formed of either Fe—Ni based alloy or Fe—Ni—Co based alloy, wherein a wedge ratio is 200% or more.

12. A color cathode ray tube comprising:

a panel of which an outer surface is substantially plane and an inner surface has predetermined curvature; and a mask for selecting colors of electron beams incident from inside of the panel, in which a formula, $0.3 \leqq (Rxe/Rxc) \leqq 0.75$ is satisfied, wherein Rxe is an inner curvature radius at an edge of a long axis of the panel, and Rxc is an inner curvature radius at a center of a long axis of the panel, wherein a formula, $Rxe \leqq Rde \leqq Rye$ is satisfied, wherein Rye is an inner curvature radius at an edge of a short axis of the panel, and Rde is an inner curvature radius at an edge of a diagonal axis of the panel.

13. A color cathode ray tube comprising:

a panel of which an outer surface is substantially plane and an inner surface has predetermined curvature; and a mask for selecting colors of electron beams incident from inside of the panel, in which a formula, $0.3 \leqq (Rxe/Rxc) \leqq 0.75$ is satisfied, wherein Rxe is an inner curvature radius at an edge of a long axis of the panel, and Rxc is an inner curvature radius at a center of a long axis of the panel, wherein the inner curvature radius is gradually decreased from a center portion of the panel towards a peripheral portion of the panel, wherein a formula, $Rxe \leqq Rde \leqq Rye$ is satisfied, wherein Rye is an inner curvature radius at an edge of a short axis of the panel, and the Rde is an inner curvature radius at an edge of a diagonal axis of the panel.

14. The color cathode ray tube of claim 8, wherein a formula, $Rxe \leqq Rde \leqq Rye$ is satisfied, wherein Rye is an inner curvature radius at an edge of a short axis of the panel, and Rde is an inner curvature radius at an edge of a diagonal axis of the panel.

15. A color cathode ray tube comprising:

a panel of which an outer surface is substantially plane and an inner surface has predetermined curvature; and a mask for selecting colors of electron beams incident from inside of the panel, in which a formula, $0.3 \leqq (Rxe/Rxc) \leqq 0.75$ is satisfied, wherein Rxe is an inner curvature radius at an edge of a long axis of the panel, and Rxc is an inner curvature radius at a center of a long axis of the panel, wherein a formula $0.3 \leqq (Rye/Ryc) \leqq 0.5$ is satisfied, and wherein Rye is an inner curvature radius at an edge of a short axis of the panel, and the Ryc is an inner curvature radius at a center of a short axis of the panel.

* * * * *